US009329006B1

(12) United States Patent
Hansen

(10) Patent No.: US 9,329,006 B1
(45) Date of Patent: May 3, 2016

(54) MAGNETIC BLADE RETAINER FOR A BROADHEAD

(71) Applicant: Daniel J Hansen, Missoula, MT (US)

(72) Inventor: Daniel J Hansen, Missoula, MT (US)

( * ) Notice: Subject to any disclaimer, the term of this patent is extended or adjusted under 35 U.S.C. 154(b) by 0 days.

(21) Appl. No.: 14/602,255

(22) Filed: Jan. 21, 2015

Related U.S. Application Data

(60) Provisional application No. 62/085,331, filed on Nov. 27, 2014.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | |
|---|---|---|---|
| 2,796,691 | A | 6/1957 | Norris |
| 2,859,970 | A | 11/1958 | Doonan |
| 5,083,798 | A | 1/1992 | Massey |
| 5,100,143 | A | 3/1992 | Puckett |
| 5,472,213 | A | 12/1995 | Dudley |
| 6,517,454 | B2 | 2/2003 | Barrie et al. |
| 6,626,776 | B2 | 9/2003 | Barrie et al. |
| 6,669,586 | B2 | 12/2003 | Barrie et al. |
| 6,935,976 | B1 | 8/2005 | Grace, Jr. et al. |
| 7,226,375 | B1 | 6/2007 | Sanford |
| 8,210,972 | B2 | 7/2012 | Adams et al. |
| 8,272,979 | B1 | 9/2012 | Cooper |
| 8,313,399 | B2 | 11/2012 | Sanford |
| 8,328,667 | B2 | 12/2012 | Adams et al. |
| 2010/0173734 | A1 | 7/2010 | Robbins |
| 2014/0128186 | A1 | 5/2014 | Treto |

OTHER PUBLICATIONS

Jon E. Silks; 2014 Broadhead Test: Mechanical vs. Sheet Metal, Bowhunging Magazine; Sep. 9, 2014; http://www.bowhuntingmag.com/gear-accessories/2014-broadhead-test-mechanical-vs-sheet-metal/.

*Primary Examiner* — John Ricci
(74) *Attorney, Agent, or Firm* — Sarah J. Rhoades

(57) ABSTRACT

A magnetic blade retainer for an expandable broadhead utilizing the properties of magnetic attraction to reliably secure a plurality of blades completely within respective blade channels so that an expandable broadhead may closely resemble the flight properties of a practice arrow tip yet lethally expand upon impact with a target. Extraneous parts are eliminated, but a strong, disc magnet is inset or integrated into the forward portion of a broadhead tip assembly. Each blade is provided with a magnetic, flat forward end. The interaction of the flat forward end and the magnet magnetically retain each blade. The magnetic bond is broken when the arrow penetrates a target. An actuating spike further transfers the impact energy to each blade. The forces on the actuating spike then drag each blade backward and each blade extends as the rearward forces are translated by the wedging surface near the end of the channel.

20 Claims, 17 Drawing Sheets

MAGNETIC BLADE RETAINER FOR A BROADHEAD

CROSS-REFERENCE TO RELATED APPLICATIONS

This patent application claims priority under 35 U.S.C. §119(e) to U.S. Patent Application Ser. No. 62/085,331 entitled "Magnetic Blade Retainer for a Broadhead" and filed on Nov. 27, 2014.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to arrowheads and more particularly to mechanical broadhead arrow tips with deployable blades.

2. Description of the Related Art

The archery industry has developed variations for folding the blades of a broadhead to serve bow hunters in the field. In these mechanical or expanding-blade broadheads the blades are operably coupled in a manner to allow the blades to move from an in-flight, retracted position to an on-impact, deployed position. The expandable broadhead is beneficial in that it is more aerodynamic than fixed-blade broadheads where the blades may serve as unintended wings and alter the intended flight of the arrow which is traveling at more than 350 feet per second. At that speed, any outside force or imperfection in the broadhead. The goal of a mechanical broadhead with expandable blades is to mimic flight characteristics similar to those of a field point tip while allowing for maximum cutting diameter and lethality more akin to fixed blade broadheads.

The first mechanical broadheads in the industry provided one or more blades partially folded such that the cutting edge was on the radially inward edge of the blade and the entire blade opened by pivoting around a point near the rear of the broadhead body. These blades require rotation from a retracted position to a deployed position about a rearward pivot point upon impact within a target, thereby exposing the cutting edge formed on the blade. Using this type of mechanical broadhead results in a substantial loss in kinetic energy to the blade rotating in a direction opposite to the flight path to end in a deployed position. As a result, less kinetic energy is available for target penetration on impact. In the field, this negative energy transfer leaves the broadhead less lethal resulting in hunting impacts which may only injure the animal. An injured animal may wonder out of an archer's sight. The archer will need to spend a great deal of time searching for the animal, but in many cases he will be unsuccessful which will leave the animal to die a protracted death as a result of its injuries and will ultimately result in a waste of the game animal.

With increasing frequency mechanical broadheads include one or more blades which longitudinally slide relative to the body from the in-flight, retracted position to the on-impact deployed position. During flight, the blades are closely positioned to the body, and upon impact the blades slide rearwardly through a range of motion to the deployed position. Specifically, the blades in this sliding-type mechanical broadhead extend from a longitudinal groove formed in the body such that the cutting edge of the blades extend radially outward from a partially-exposed to fully-exposed diameter. The current designs of such broadheads are less robust or reliable compared with other types of mechanical broadheads. Pins, elastics, gages, rubberbands, or other retaining mechanisms operably couple the blade to the body of the broadhead adding complexity to the design and opportunities for parts to be damaged during use, storage, or shipment. The mechanisms used to retain the broadhead blades during nocking and flight add a layer of unreliability to the broadhead causing them to malfunction at inopportune times such as in-flight or upon impact. Even though a few prior art references have paid passing, cursory mention to the idea of employing magnets in various elements of a mechanical broadhead body, no invention has disclosed how to implement the magnet, a successful implementation has not been disclosed. A need exists to successfully employ a magnet as the sole retaining device for the blade of an expandable broadhead. Despite recent developments in the broadhead art, and in particular use of powder injection molding for the manufacture of components adding significant flexibility in the design and manufacture of blade designs, broadheads still need improvement

BRIEF SUMMARY OF THE INVENTION

The present invention is a new blade retainer for a broadhead arrow tip attachable to an arrow shaft, the blade retainer comprising a blade having a planar or flat surface on its leading end, while a magnet is disposed in the broadhead tip resulting in the blade being securely held to the magnet by the magnetic attraction of the flat blade end to the magnet. In the preferred embodiment, the blade retainer for an expandable broadhead comprises a flat forward face of a blade and a magnet disposed in the tip of the broadhead wherein the magnet acts to hold the blade in a compressed disposition by forces of magnetic pull between the magnet and the flat forward face of the blade.

In the preferred implementation of the invention, the broadhead is adapted for attachment to an arrow-shaft. The broadhead is formed of a body attachable to a tip. The magnet is integrated within the tip. The broadhead body is provided with channels within which a plurality of blades may be installed. In this embodiment, the blades slide rearwardly to an outwardly extending position when the broadhead impacts a target. The blades may be manually returned to their stowed position when they are slid forward to return to the compressed, in-flight blade position and again held by the magnetic blade retainer until the next frontal impact. In this preferred implementation, the blades are entirely hidden within the channels when they are folded in the compressed, in-flight position. In one implementation of the invention, the blades will be provided with a protrusion which exceeds the external margins of the body. These protrusions may be spikes or hooks integrated into the blade. These actuating spikes protrude from the exterior of the broadhead to contact the target and transfer the force of impact to the blade such that the blade begins to move rearwardly with enough force to overcome the magnetic forces of attraction holding the blade to the magnet. Therefore, the actuating spikes act to assist with breaking the magnetic bond holding the blades in a compressed position and further act to transfer energy to drag the blades within the channels to an expanded, cutting position. In the preferred embodiment, a plurality of blades are preferred; however, each blade will move independently of the other blades. Each blade has a flat forward face which, when folded, is attracted by magnetic force to the magnet in the tip. The magnetic attraction of the flat forward face of each blade is held securely by the flat surface of a powerful magnet inset in the tip.

With the arrangement provided herein, the rearward and resulting radial shifting of the blades results from the entry of the broadhead into the object upon contact. The deployed blades will expose hide or flesh cutting surfaces to cause maximum damage to the impacted target.

The body for the preferred broadhead using the magnetic retainer will be sufficiently sized to receive a plurality of folded blades within the external margin of its radial circumference. External threading will be provided on each of the distal and proximal ends. The threading on the proximal end will cooperate with the arrow shaft. The distal threading will cooperate with threading on the tip so that the tip may be removably attached to the body. Sliding channels punch all of the way through the distal end of the body. The sliding channels provide the paths through which blades may slide during deployment and then back through compression or even replacement when blades become damaged. In the preferred implementation, a bulbous sliding mechanism is integrated into the blade to facilitate the secure sliding in the channels and act as a channel stopper to halt the blade a the end of the channel. The blade further comprises a protruding, actuating spike near the bulbous structure and the flat distal surface abutting the magnetic tip. The proximity on the blade between the spike, the face, and the bulbous structure will facilitate maximum energy transfer upon impact. In the preferred implementation, the entirety of the blade is disposed within the body until it is deployed by impact with a target when the protruding spike actuates a separation of the magnetic force holding the blade to the magnetic tip.

The employment of the present invention permits successful sliding of an entire, lethal blade within a broadhead body without any external parts or retainers. The magnetic blade retainer will have advantageous uses in any broadhead having blades which move in any manner including but not limited to folding, articulating, pivoting, or sliding. There is no requirement for extraneous fasteners such as pins, rods, or rings to hold the blades in place. The only retaining force is provided by magnetic forces. When the blades are compressed for storage, nocking, or flight, the only visible portion of the blade is the integral spikes used to transfer the kinetic energy and deploy the blades upon impact with the target. The open-on-impact feature of the present retaining member is very important for user safety and effective harvesting of game. Stowed blades will allow the arrow to fly straighter and strike the intended target with more accuracy. The deploying blades will increase the cutting diameter and ensure that the target will not escape to die in isolation. With part count minimized, failure risk in minimized and noise from rattling of blade components is reduced.

The foregoing has outlined, in general, the physical aspects of the invention and is to serve as an aid to better understanding the more complete detailed description which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow.

DETAILED DESCRIPTION OF THE INVENTION

Figure 1:
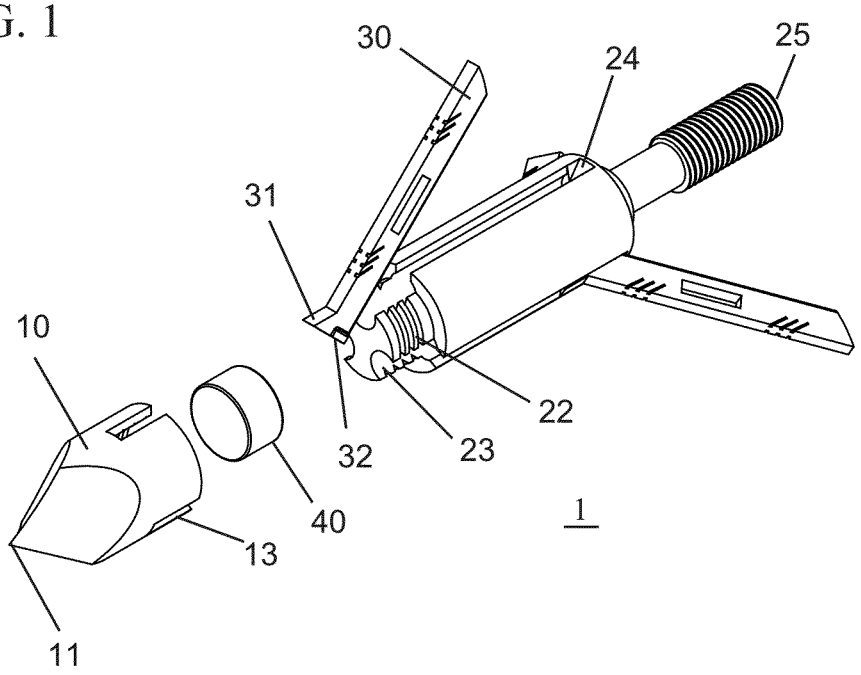
FIG. 1 is a partially disassembled, perspective view of the blade retaining magnet in a broadhead according to the present invention.
Figure 2:
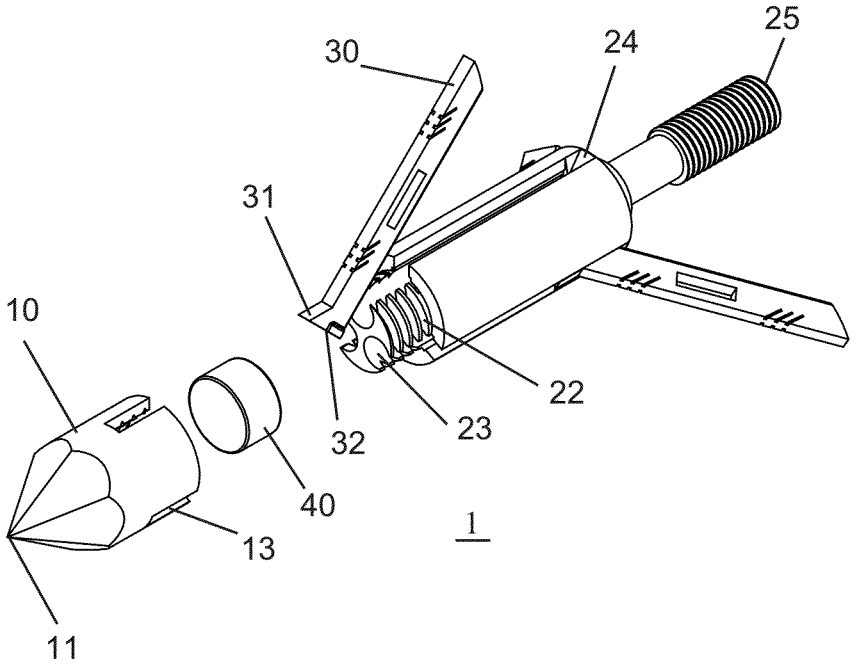
FIG. 2 is a partially disassembled, perspective view of the magnetic blade retainer implemented in an alternative broadhead embodiment according to the present invention.
Figure 3:
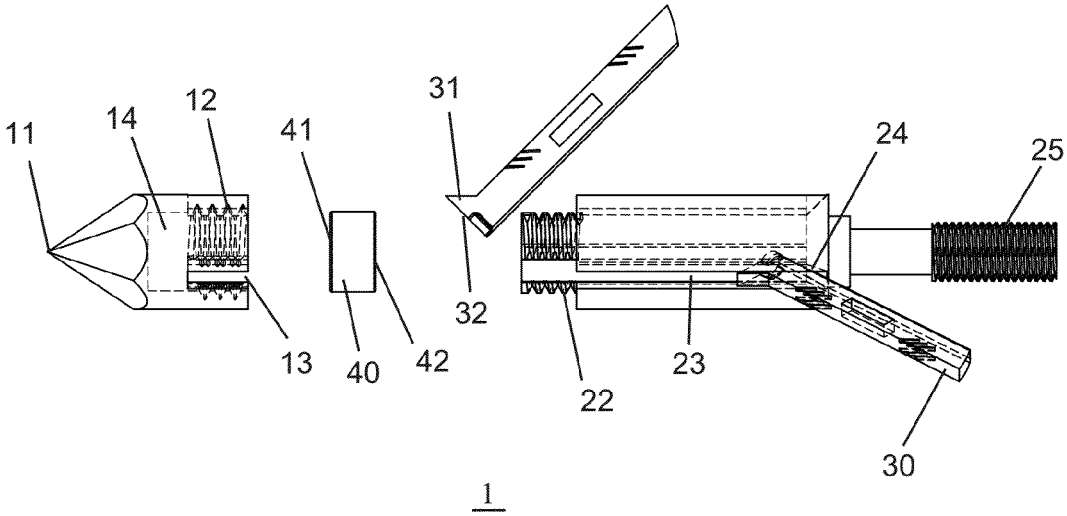
FIG. 3 is a partially transparent side view of the embodiment illustrated in FIG. 2.

In accordance with the accompanying drawings, applicant's magnetic blade retainer for a broadhead includes a magnet 40 and a blade 30 for use with a broadhead 1. As illustrated in FIGS. 1-3, when the magnetic blade retainer is implemented, it will be joined with other broadhead 1 components including a body 20 and a tip assembly cap 10. The magnet 40 occurs within the tip assembly cap 10. Each blade 30 lies completely within the body 20 in a blade channel 23. In the preferred instance, when each blade 30 is folded, it is contained within the external margins of the body 20. When fully assembled, each blade 30 is slidably fixed in a blade channel 23 and the magnet 40 lies in the magnet cavity 14 between the body 20 and the tip 11. See FIG. 3. The cooperation of the respective threaded aspects of the tip assembly cap 10 and the body 20 secure the body 20 to the tip 10. The body blade channel 23 aligns with the tip blade channel 13 to allow full movement of each blade 30 from the stowed or in-flight, compressed position to the deployed, expanded position. The proximal end of the body 20 is provided with a mechanism to attach to an arrow shaft. As shown in FIGS. 1-3, a threaded arrow shaft receiver 25 will permit the distal end of an arrow (not shown) to be joined with the broadhead 1.

The planar, or flat forward face 32 of each blade is held securely by forces of magnetic attraction to the flat surface 42 of a powerful magnet inset in the tip. With reference to FIG. 3, the preferred magnet 40 is a disc-style magnet with very strong magnetic properties and having a distal face 41 and a proximal face 42. The magnet 40 desirably presents at least a proximal face 42 in order to allow maximum magnet attraction between the magnet and the front face 32 of the blade 30. In the preferred embodiment, the magnet 40 lies completely within the tip inset, magnet cavity 14 beyond the cap threading 12. The blade 30 slides completely within the channel created by the alignment of the body channel 23 and the tip channel 13 when the tip assembly or cap 10 is secured to the body 20.

Figure 4:
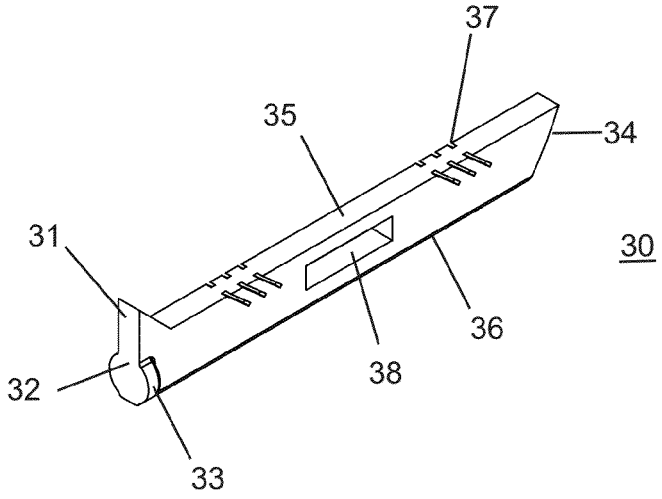
FIG. 4 is a perspective view of a blade according to the present invention when removed from the broadhead body.
Figure 5:
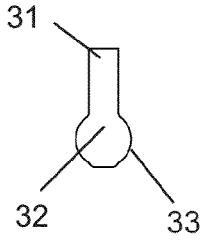
FIG. 5 is a tip-end view of a blade according to the present invention when removed from the broadhead body.
Figure 6:
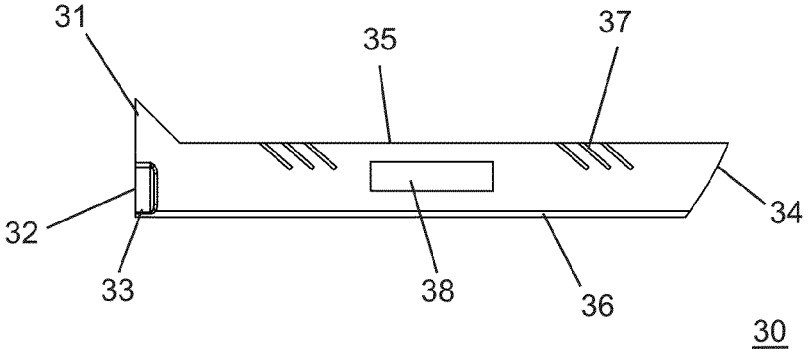
FIG. 6 is a side plan view of a blade according to the present invention when removed from the broadhead body.

The blade 30 has important elements to facilitate the proper functioning and use of the magnetic retainer for the broadhead 1. In FIGS. 4-6, a blade according to the preferred embodiment will be comprised of a flat forward face 32 at the leading edge of the blade. The forward face 32 is formed to lie perpendicular to the longitudinal surface of the blade, broadhead, and thus flight path of the broadhead. The flat forward face 32 provides an optimal surface to interact with the magnet 40, particularly the flat proximal face 42 of the magnet shown in FIG. 3. A bulbous sliding mechanism, bulge, boss, jut, or other protruding structure 33 near the forward face 32 of the blade 30 fulfills two objectives in the preferred implementation of the present invention. First, the protrusion 33 slidably secures the blade 30 in the blade channel 23 by interaction with, or retention by the blade channel lip 27 better shown in FIG. 7. Next, the protrusion 33 acts as a channel stopper for the blade 30 so that the blade 30 is expanded to a maximum cutting diameter but held at that location and not allowed to exit the broadhead. An actuating spike, also called a hide hook 31 extends vertically to protrude toward the distal end of the blade 30. In the preferred embodiment, the actuating spike 31 is disposed directly above the flat forward face 32 of the blade and the bulbous sliding structure 33. The blade 30 has a cutting edge 35 and a supporting edge 36. The blade 30 is further supported by the interface fit of the angled rear edge 34 against the angled wedging surface 24 of the blade channel 23 when the blade 30 is in a closed, in-flight position. This design also maximizes the cutting surface 35 and diameter of destruction of the blade. In preferred designs, the blade 30 may also have serrations 37 placed in the cutting edge 35, again to enhance the destructive cutting power of the broadhead 1. Windows or slots 38 may be excised from the blade 30. This design feature has the added benefit of reducing the weight of the blade 30 which optimizes immediate deployment at impact.

Figure 7:
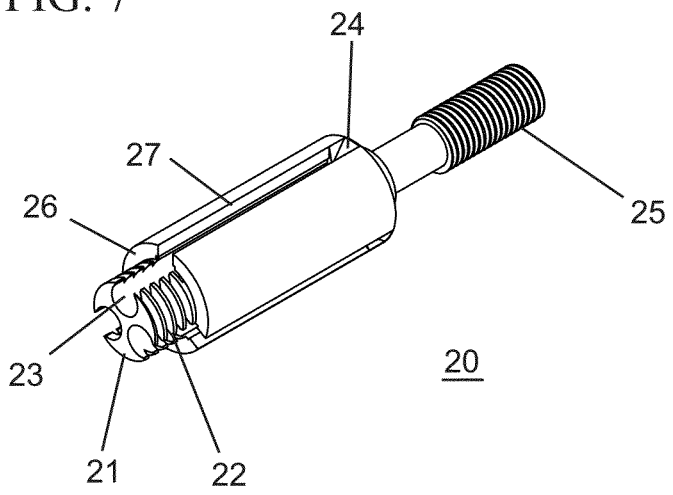
FIG. 7 is a perspective view of the broadhead body for the preferred implementation of the magnetic retainer with the tip, magnet, and blades removed.
Figure 8:
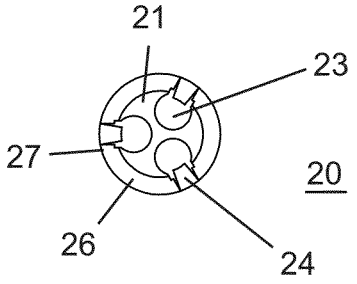
FIG. 8 is a tip-end view of the broadhead body shown in FIG. 7.
Figure 9:
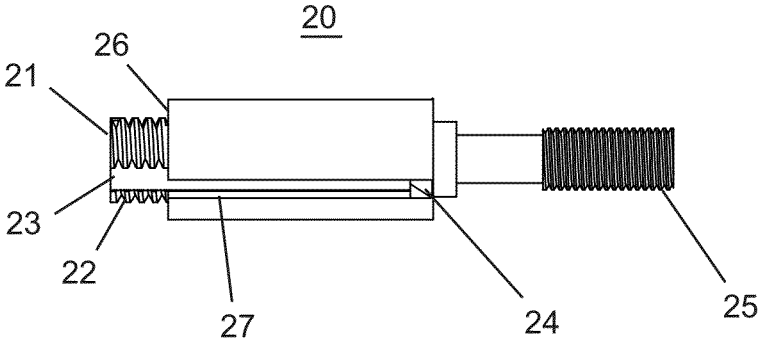
FIG. 9 is a side plan view of the broadhead body shown in FIGS. 7-8.
Figure 10:
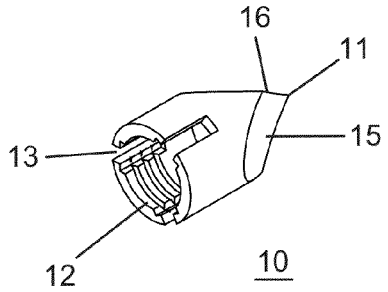
FIG. 10 is a rear perspective of a tip assembly cap removed from a broadhead body according to the preferred implementation of the magnetic retainer.
Figure 11:
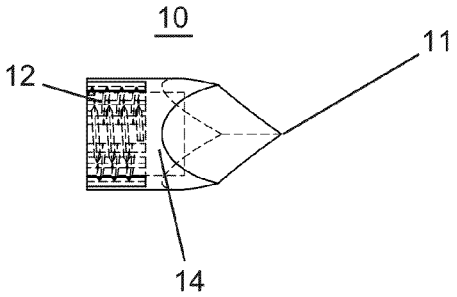
FIG. 11 is a partially transparent view of a tip assembly cap removed from a broadhead body according to the preferred implementation of the magnetic retainer.
Figure 12:
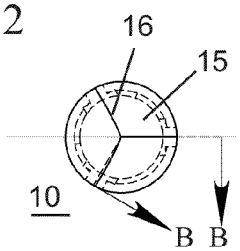
FIG. 12 is a tip-end view of a tip assembly cap removed from a broadhead body according to the preferred implementation of the magnetic retainer.
Figure 13:
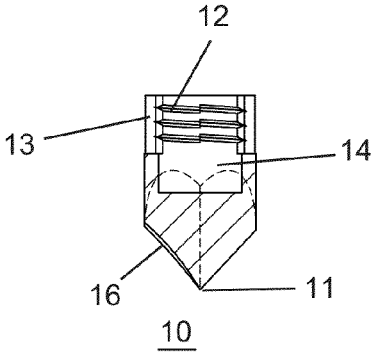
FIG. 13 is a sectional view taken along line B-B in FIG. 12.
Figure 14:
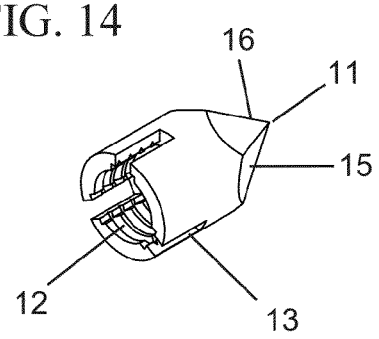
FIG. 14 is a rear perspective of a tip assembly cap removed from a broadhead body according to another implementation of the magnetic retainer.
Figure 15:
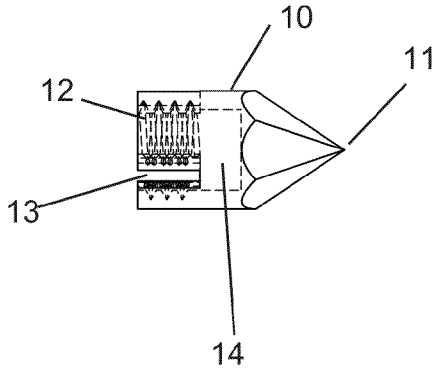
FIG. 15 is a partially transparent view of a tip assembly cap removed from a broadhead body according to another implementation of the magnetic retainer.
Figure 16:
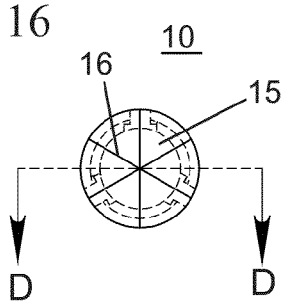
FIG. 16 is a tip-end view of a tip assembly cap removed from a broadhead body according to another implementation of the magnetic retainer.
Figure 17:
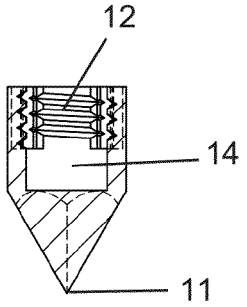
FIG. 17 is a sectional view taken along line D-D in FIG. 16.
Figure 18:
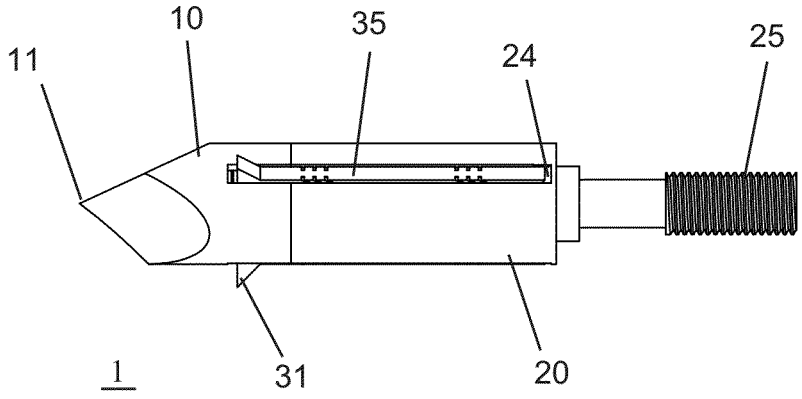
FIG. 18 is a side plan view of a magnetic broadhead with the blades in a retracted position.
Figure 19:
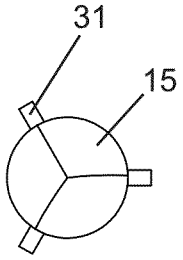
FIG. 19 is a tip-end view of a magnetic broadhead with the blades in a retracted position.
Figure 20:
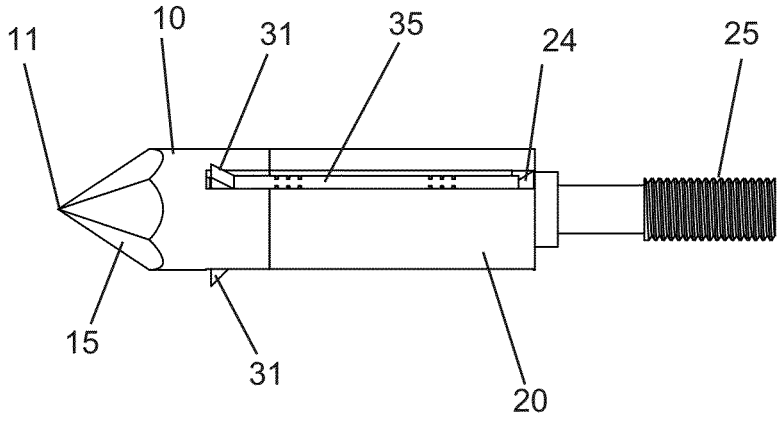
FIG. 20 is a side plan view of another magnetic broadhead with the blades in a retracted position.
Figure 21:
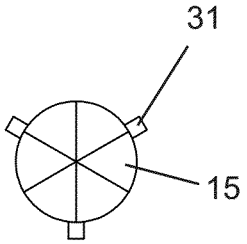
FIG. 21 is a tip-end view of another magnetic broadhead with the blades in a retracted position.
Figure 22:
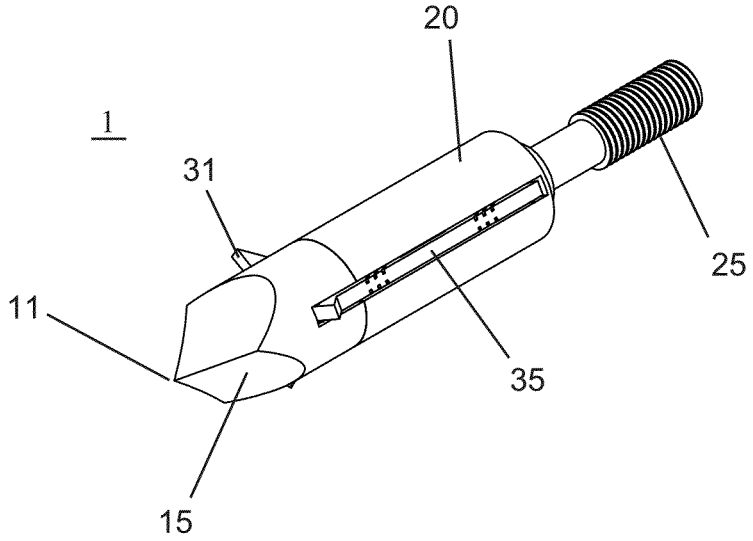
FIG. 22 is a perspective view of a magnetic broadhead with the blades in a retracted position.
Figure 23:
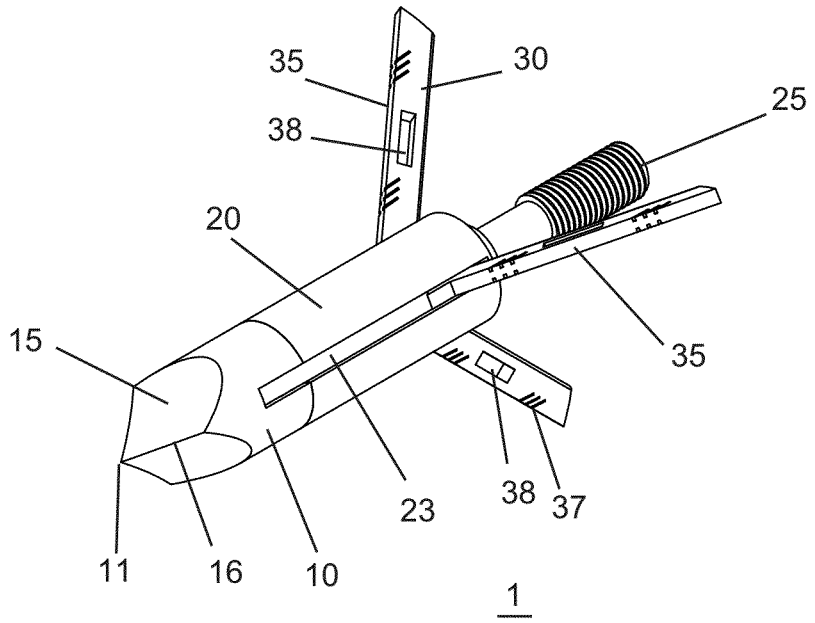
FIG. 23 is a perspective view of a magnetic broadhead with the blades in a deployed position.
Figure 24:
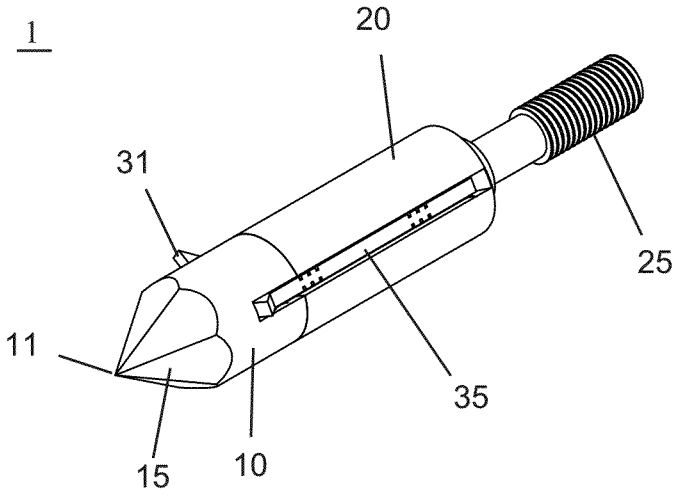
FIG. 24 is a perspective view of another magnetic broadhead with the blades in a retracted position.
Figure 25:
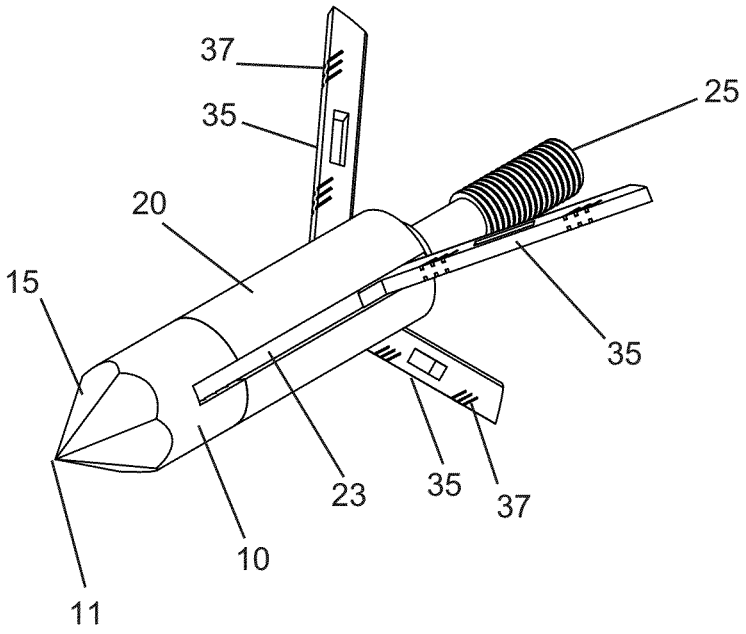
FIG. 25 is a perspective view of another magnetic broadhead with the blades in a deployed position.
Figure 26:
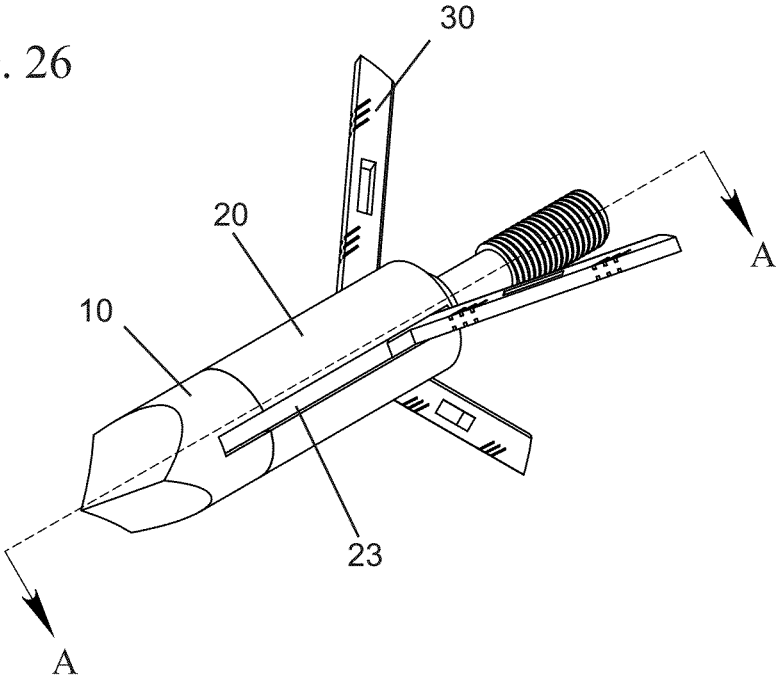
FIG. 26 is a perspective view as shown in FIG. 23 with cross sectional indicators.
Figure 27:
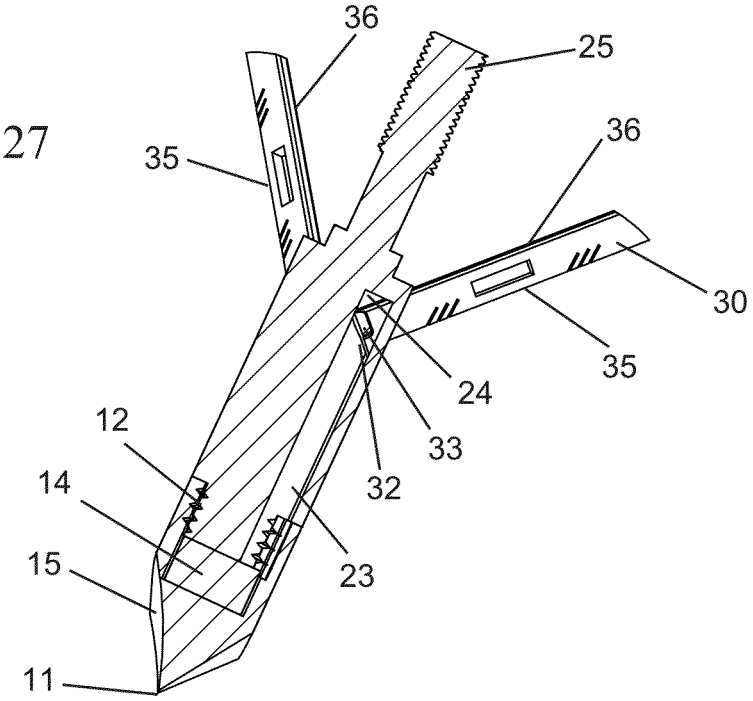
FIG. 27 is a longitudinal sectional view taken along line A-A in FIG. 26.
Figure 28:
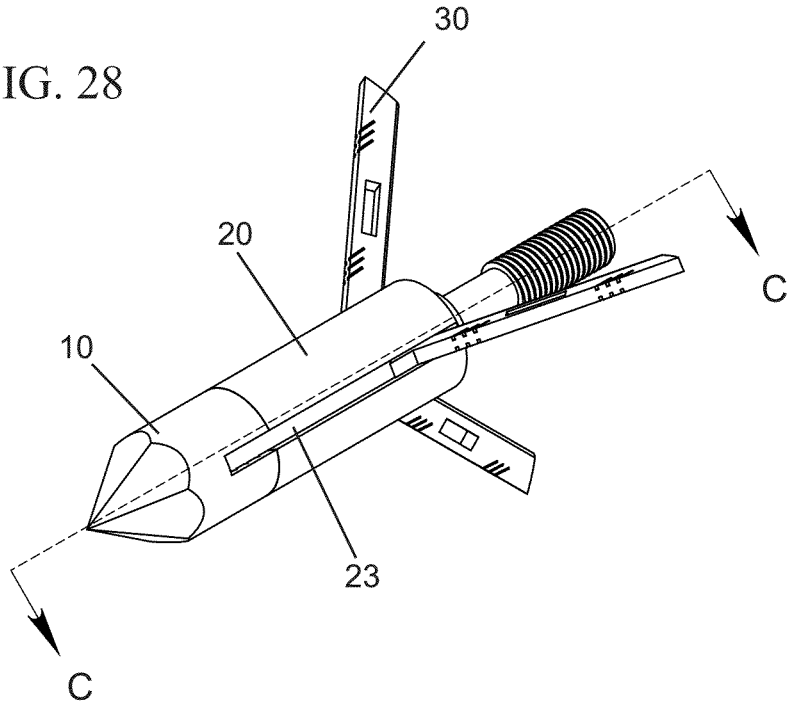
FIG. 28 is a perspective view as shown in FIG. 25 with cross sectional indicators.
Figure 29:
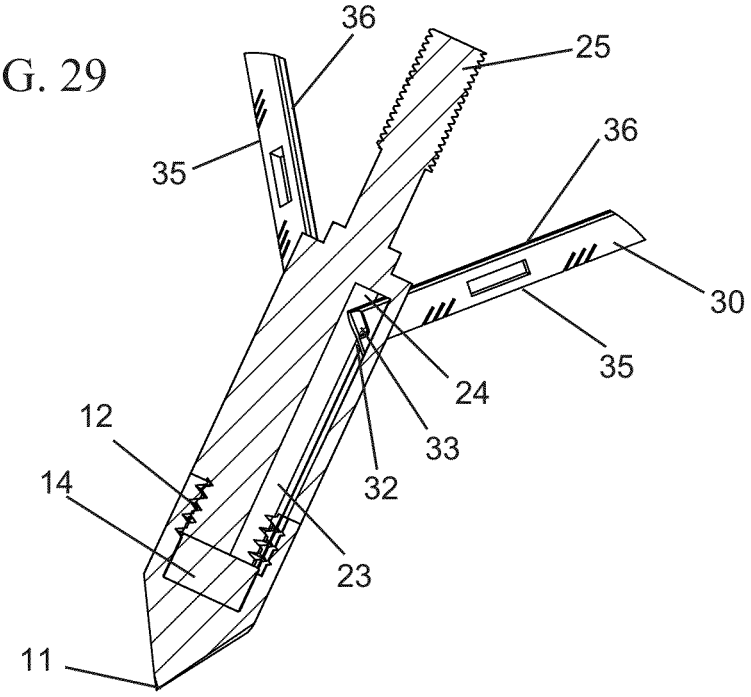
FIG. 29 is a longitudinal sectional view taken along line C-C in FIG. 28.

Referring to FIGS. 7-9, the body 20 of the present invention is a longitudinally extending body with a radial circumference. The body 20 is substantially comprised of a tail and arrow shaft attachment section 25, a support section, and a cap receiver section. Multiple blade channels 23 occur in the support section and the cap receiver section to receive multiple blades 30 within the external margins of the body. For assembly, the blades 30 are inserted into the channels 23 and the cap 10 is secured with the body threads 22. See also FIGS. 1-3. When assembled, the cap 10 and the body 20 are radially aligned and share one external margin. To better secure the body 20 to the cap 10 and complete the blade channel 23 for smooth blade actuation, a planar distal face 21 is provided in the portions of the body leading end not traversed by the blade channels 23. A body rim 26 acts as a stop to abut the cap 10 when the cap 10 and body 20 are assembled. The performance of the channels 23 is maximized by the inclusion of a lip 27 and a wedging surface 24 within each channel. The lip 27 cooperates with the bulbous bulge 33 of the blade 30. The bulge 33 slides within the channel 23 and is retained by the lip 27. When the magnetic pull of the magnet 40 on the forward blade face 32 is disrupted, the blade 30 begins to slide rearwardly. The rear edge 34 of the blade will depart the channel 23 and the supporting edge 36 will slide against the wedging surface 24 and urge the blade to exit the channel 23 and continue to the open or deployed position. When the bulge 33 comes to the rear of the channel 23 it will perform its second task which is to stop the blade at the end of the channel. The channel stop 33 comes into contact with the channel lip 27 and the support edge 36 of the blade 30 has its angle set by the pitch of the wedging surface 24. The interference fit between the lip 27 and the wedge surface 24 will hold the blade 30 tightly, guide it toward the rear of the channel, and prevent the entire blade 30 from exiting the back of the channel 23. In the preferred embodiment, the pitch of the wedging surface 24 will be set at forty-five degrees) (45°).

Figure 30:
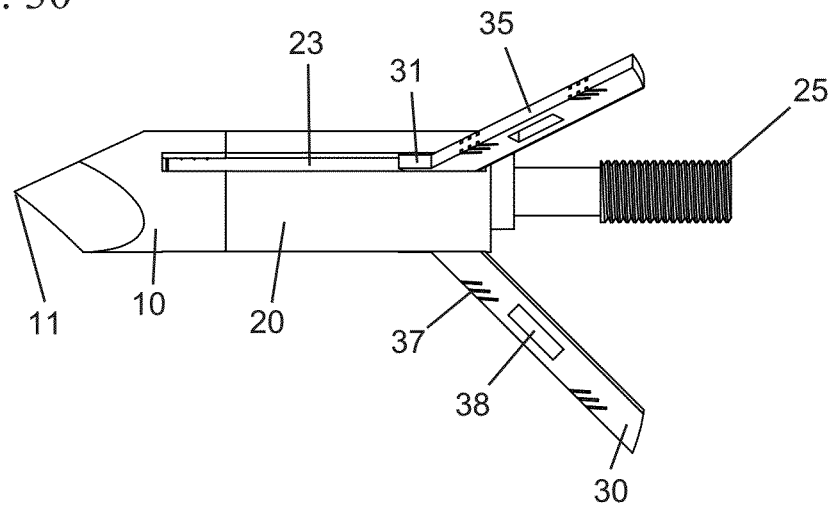
FIG. 30 is a side plan view of a magnetic broadhead showing the blades in a deployed position.
Figure 31:
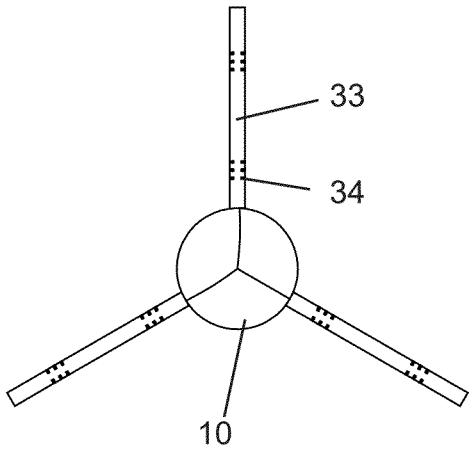
FIG. 31 is a tip-end view of FIG. 30.
Figure 32:
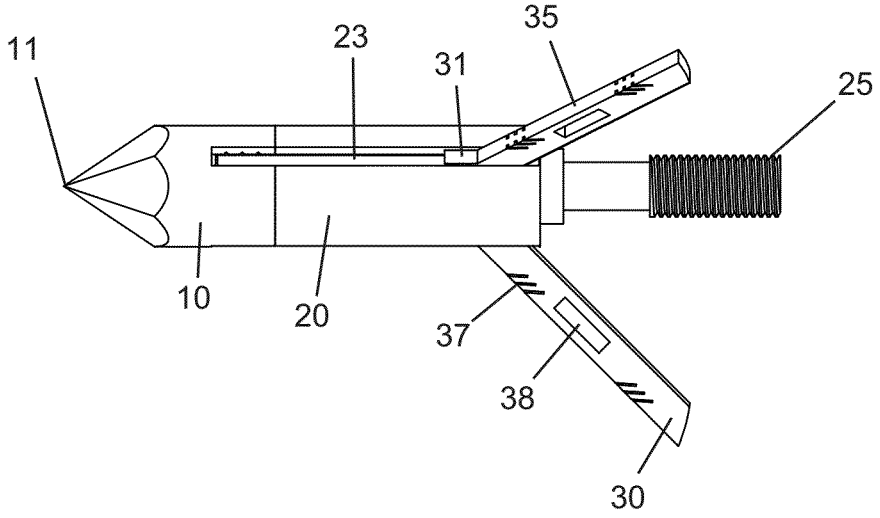
FIG. 32 is a side plan view of another magnetic broadhead showing the blades in a deployed position.

The tip assembly cap 10 is isolated in FIGS. 10-13. In the preferred embodiment, facets provide a penetrating end consisting of three cutting surfaces 15 and three cutting edges 16. An alternative tip design is shown in isolation in FIGS. 14-17 where a penetrating end consisting of a plurality of cutting surfaces 15 and a plurality of cutting edges 16. The tip 11 is the convergence of the cutting edges 16 and the space between creates the cutting surfaces 15. In either embodiment, it is preferred that a cutting edge 16 is aligned with tip blade channels 23, and therefore the body blade channels 23. See illustration of this alignment in FIGS. 30-32. The penetrating end enhances the entry of the blade cutting edge 35 and thus the lethality of the broadhead as it enters its target. The preferred threading 12 for the cap 10 to be joined with the body 20 is illustrated in FIGS. 10-17. The cap threading 12 will begin at the rear most portion of the cap 10 to mate with the forward most body threading 22. The cap threading 12 will terminate with the end of the blade channels 13 such that the magnet 40 lying in the magnet cavity 14 will be forced into direct contact with the blade flat face 32 when the blade 30 is inserted into the blade channel 23 and the cap 10 is threaded to the body 20.

With reference to FIGS. 18-22, the broadhead 1 is shown fully assembled but with the blades 30 in a closed, compressed position. The broadhead 1 is ready to be joined with an arrow shaft (not shown) and nocked, aimed, and loosed. The compressed, blades 30 are fully hidden so that only the actuating spikes 31 are visible. Looking through the top of the channel, the cutting edge 35 can be viewed. The broadhead in this configuration resembles or is very similar to the arrow tips, called field point or target point tips, used by archers when target practicing. The similarity between the present broadhead and the practice tips will maximize the consistent, trustworthy flight of the arrow so that the archer may hone the accuracy of his aiming skills. Then, when the archer's accuracy is vital to the successful destruction of a target, the broadhead 1 is more likely to perform as expected by the archer and result in a lethal first contact.

Referring to FIGS. 22-25, the before and after—closed to open—illustrations show the conversion of the target point-like broadhead to the expanded broadhead for cutting destruction. During use, the actuating spike 31 makes contact with the target and breaks the magnetic bond between the magnet 40 and the front face 32 of the blades 30 shown in FIGS. 1-17. The magnetic bond retains the blade 30 in the compressed formation until the leading end of the broadhead 1 comes into contact with a target. Upon contact, the penetrating tip 11 and cutting edges 16 and cutting surfaces 15 initiate entry of the broadhead 1 into the target. Once the penetration reaches the actuating spikes 31, the force against the spikes 31 will completely separate the blade 30 front face 32 from the magnet 40.

Reviewing FIGS. 26-29 will illuminate how this action breaks the magnetic bonds and begins the sliding of the bulb 33 of each blade 30 in the respective cap channels 13 and aligned body channels 23. The force of impact on the spikes 31 acts to slide the blades 30 back toward the arrow shaft, pushing the blades 30 against the wedging surface 24 until the bulb 33 abuts the channel lip 27. The exposed cutting surfaces 35 enlarge the entrance wound caused by the broadhead 1 to the target.

The figures are presented to show the broadhead 1 in sets dictated by the broadhead versions. In each set of illustrations, the blades 30 are shown in a first position and a second position from various angles. In the first position shown in FIGS. 22 and 24, the blades 30 are compressed and the broadhead is ready for nocking, aiming, loosing, flight and initial penetration. Upon impact, the blades will make a smooth transition from the first position to the second position. In the second position shown in FIGS. 23 and 25, the blades 30 are extended as they will be after initial penetration to a fully open position as they will be when the impact is completed and the arrow has come to rest in its target.

With continuing reference to the sectional views of FIGS. 26-29, when in the extended disposition, the wedging surface 24 supports the blade support edge 36. The blades 30 are urged toward the extended disposition during passage of the broadhead 1 through the target as result of the force generated on actuating spike 31 upon impact and penetration of the tip 11. The transverse component of the force generated on the portion of the blade 30 forward of the point of contact with the wedging surface 24 being greater than the transverse component of the force generated on the portion of the blade 30 rearward of the point of contact with the wedging surface 24 continues to force the blade 30 toward an open, expanded position. The proximity on the blade between the spike, the face, and the bulbous structure will facilitate maximum energy transfer upon impact.

Figure 33:
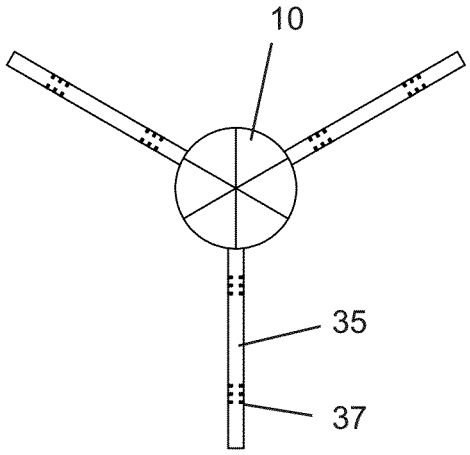
FIG. 33 is a tip-end view of FIG. 32.

Referring again to FIGS. 31 and 33, the cutting radius of an expanded broadhead when the blades are extended, compared with the end views of the blades 30 when retracted (see FIGS. 19 and 21) is immediately apparent. The attributes of the present invention will allow cutting diameters to be maximized. By way of example and not by way of limitation, the cutting diameters will range from 1.75 inches to 2.25 inches.

After use, the blades 30 are returned to their blade channels 13 and 23 by manual intervention of the archer. An archer may choose to clean, repair, or replace used blades 30 after use but once prepared, the blades are manually laid flat in the blade channels 23, 13 and the magnetic connection with the forwardly disposed magnet 40 is renewed. The renewed attraction will hold the blades 30 once again in a retracted, closed position as illustrated for example in FIGS. 18-22 and 24.

A broadhead 1 implementing the instant technology will desirably be sold separately from arrow shafts for purchase by archers. The archer will couple the broadhead with an arrow shaft by complementary threading or other acceptable means of joinder. The present invention can be implemented with any broadhead and therefore will fit any arrow size. The broadhead 1 is sold assembled, but may be disassembled as illustrated in FIGS. 1-3 when the cap 10 is screwed off of the body 30 thereby exposing the opening of the blade channels 23 in the body 20. When disassembled, the blade bulb 33 can slide free of the channel at the front face 21 of the body. This feature will permit blade replacement as may be necessary for selectable blade use or replacement of dulled or damaged blades 30. The disassembly of the broadhead 1 will also expose the magnetic area. The magnet 40 may be free standing and separable as illustrated in FIGS. 1-3, or it may be fabricated with the cap 10. The placement of the magnet 40 will be desirably disposed near the front of the broadhead 1 to achieve the objectives stated herein. The magnet's placement near the tip of the broadhead 1 will provide the broadhead with better balance and a forwardly disposed weight to maximize optimal flight attributes of the arrow. The weight-forward model will also reduce deflection on steeply angles shots.

The blades 30 may be fabricated of any material that will meet the objective of a broadhead blade so long as the flat front face 32 of the blade 30 is comprised of a material with an affinity for, or substantial attraction to a magnet force. The magnetic properties of the front face 32 of the blade may be integral to or applied to the blade 30 and or blade face 32. The bulb 33 may be an integral part of the blade 30 or joined or coupled with the blade. The actuating spike 31 is desirably fabricated as integral to the blade 30 but may be joined with the blade as a separate component or as part of addendum to the blade comprising the spike, magnetic affinity aspect, and sliding bulb. The implementing broadhead 1 is desirably fabricated of a strong metal material such as aircraft-grade aluminum, steel, or an alloy. At least the cutting surfaces of the blade will be manufactured from materials such as stainless-steel and may be hardened, sharpened, or diamized by known techniques.

The present invention has refined and perfected a simple device for retaining the blades of an expandable broadhead and then also implementing the reliable expansion of the blades upon impact, and only upon impact. Because the blades are independently held to the retaining magnet, the part count is minimized, resulting in lower manufacturing costs and ease of assembly. The present invention has no need for fasteners, blade clips, blade set screws, O-rings, elastics or similar parts. Further, the present invention does not employ connecting rods or other additional translating ring components to connect blades together. With part count minimized, failure risk in minimized. The magnetic retainer of the present invention will reduce noise from rattling of blade components.

Regardless of the broadhead style or tip style used to implement the present invention, multiple blades will be distinctly preferred. The preferred embodiment will utilize three blades having their own blade channels in the body and cap and having their own independent contact point with the magnet. In the preferred embodiment, the blades move independently of one another, but joint movement will be possible with slight modifications. The magnet blade retainer will primarily serve 100 grain arrows but can be employed for any arrow weight.

It is further intended that any other embodiments of the present invention which result from any changes in application or method of use or operation, method of manufacture, shape, size, or material which are not specified within the detailed written description or illustrations contained herein are yet considered apparent or obvious to one skilled in the art are within the scope of the present invention.

I claim:

1. A blade retainer for a broadhead, the blade retainer comprising:
- a blade having a flat face,
- a magnet disposed in the broadhead,
- wherein the magnet holds the blade in position by forces of magnetic attraction between the magnet at the flat face of the blade, and
- wherein the flat face is perpendicular to a broadhead flight path.

2. The blade retainer of claim 1, wherein the flat face occurs at a leading edge of the blade.

3. The blade retainer of claim 1, wherein the broadhead further comprises a tip portion and the magnet occurs within the tip portion of the broadhead.

4. The blade retainer of claim 1, wherein blade further comprises an actuating spike.

5. The blade retainer of claim 4 wherein an actuating spike disrupts the magnet attraction between the blade and the magnet when a broadhead strikes a target.

6. A blade retainer for holding blades of an expandable broadhead in a compressed disposition until the broadhead impacts a target, the blade retainer comprising:
- a blade having a flat forward face,
- a magnet forwardly disposed in the broadhead,
- wherein the magnet holds the blade in a forward position by magnetic forces between the magnet and the blade flat forward face such that the impact on the target will overcome the magnetic forces of attraction and release the blades to an expanded position.

7. The blade retainer of claim 6, wherein the flat face is perpendicular to a broadhead flight path.

8. The blade retainer of claim 6, wherein the flat forward face occurs at a leading edge of the blade.

9. The blade retainer of claim 6, wherein the magnet is used to retain more than one blade.

10. The blade retainer of claim 6, wherein the blade further comprises an actuating spike which protrudes from the broadhead to contact the target and transfer the force of impact to the blade such that the blade begins to move rearwardly toward an expanded position.

11. An expandable broadhead comprising:
- a plurality of sliding blades, each sliding blade further comprising:
  - a cutting edge and a supporting edge,
  - a planar forward face,
  - an actuating spike disposed near the planar forward face, and
  - a bulbous sliding mechanism disposed below the actuating spike,
  - an angled rear edge,
    - wherein at least the planar forward face is constructed of a material having strong magnetic properties,
- a body having an external margin sufficient to wholly enclose each sliding blade except the actuating spike, the sliding blade enclosed such that the cutting edge is disposed within the external margin,
  - the body further comprising,
    - a plurality of channels, each channel shaped and sized to slidably receive and guide the bulbous sliding mechanism of each blade,
    - an arrow shaft attachment proximally disposed on the body,
    - a leading end having a plurality of channel openings, threading at the leading end,
- a tip assembly cap having a forward penetrating tip, a plurality of cutting faces, a plurality of cutting edges, an inset cavity to receive a magnet, and threading to receive the threading of the body,
  - the tip assembly cap further comprising a plurality of channels to alight with the body channels,
- a magnet sized and shaped to fit within the cavity of the tip assembly cap,
  - the magnet having a planar distal face to abut the planar forward face of each sliding blade,
    - wherein the planar forward face of each sliding blade is held by magnetic forces of attraction thereby retaining each blade within the channels until the penetrating tip enters a target up to the actuating spike such that the impact forces interrupt the magnetic force retaining each blade and the actuating spike further drags each blade backward to fully deploy the blades into a cutting position.

12. The expandable broadhead of claim 11, wherein the actuating spike comprises a leading edge adjoined with the planar forward face of the blade.

13. The expandable broadhead of claim 11, wherein each sliding blade moves independently of every other sliding blade.

14. The expandable broadhead of claim 11, wherein the channel further comprises a lip to securely hold the bulbous sliding mechanism.

15. The expandable broadhead of claim 11, wherein the channel further comprises a wedging surface.

16. The expandable broadhead of claim 15, wherein the wedging surface urges the blade to exit the channel in an expanding motion when the actuating spike is drug backward after impact.

17. A blade retainer for a broadhead, the blade retainer comprising:
- a blade having a flat face,
- a magnet disposed in the broadhead, wherein the magnet holds the blade in position by forces of magnetic attraction between the magnet at the flat face of the blade, and the flat face occurs at a leading edge of the blade.

18. The blade retainer of claim 17, wherein the broadhead further comprises a tip portion and the magnet occurs within the tip portion of the broadhead.

19. The blade retainer of claim 17, wherein blade further comprises an actuating spike.

20. The blade retainer of claim 19, wherein an actuating spike disrupts the magnet attraction between the blade and the magnet when a broadhead strikes a target.

* * * * *